US006777903B1

(12) United States Patent
Ostwald

(10) Patent No.: US 6,777,903 B1
(45) Date of Patent: Aug. 17, 2004

(54) WEDGE TYPE PARALLEL JAW GRIPPER FOR AUTOMATED DATA STORAGE LIBRARY

(75) Inventor: Timothy C. Ostwald, Louisville, CO (US)

(73) Assignee: Storage Technology Corporation, Louisville, CO (US)

( * ) Notice: Subject to any disclaimer, the term of this patent is extended or adjusted under 35 U.S.C. 154(b) by 4 days.

(21) Appl. No.: 10/237,937

(22) Filed: Sep. 9, 2002

(51) Int. Cl.[7] ..... B25B 7/00

(52) U.S. Cl. ..... 318/568.21; 901/31; 901/38; 269/87.1; 269/87.2; 269/234

(58) Field of Search ..... 318/568.21; 269/87.1, 269/87.2, 234; 901/31, 38; 294/119.1, 902

(56) References Cited

U.S. PATENT DOCUMENTS 3,575,301 A * 4/1971 Panissidi ..... 414/618
3,625,503 A * 12/1971 Hall ..... 269/234
3,698,599 A * 10/1972 Fernstrom ..... 221/25
3,933,220 A * 1/1976 Swager ..... 182/3
3,999,455 A * 12/1976 Wetzels et al. ..... 83/320
4,165,044 A * 8/1979 Batch ..... 241/264
4,793,038 A * 12/1988 Guerout et al. ..... 29/33 M
5,127,696 A * 7/1992 Awano et al. ..... 294/102.1
5,180,461 A * 1/1993 Widmann ..... 156/216
5,737,820 A * 4/1998 Ferrari et al. ..... 29/243.5
5,894,754 A * 4/1999 Sartorio ..... 72/422
5,918,284 A * 6/1999 Blanch et al. ..... 73/827
6,119,972 A * 9/2000 Vogel et al. ..... 242/443
6,715,332 B2 * 4/2004 Klingen et al. ..... 72/291
2003/0030294 A1 * 2/2003 Michler et al. ..... 294/88

* cited by examiner

*Primary Examiner*—Rita Leykin
(74) *Attorney, Agent, or Firm*—Yee & Associates, P.C.

(57) ABSTRACT

The present invention provides a robotic gripper mechanism. The invention comprises gripping jaws and a wedge that moves along angled groove between the gripping jaws. The angled grooves are connected to the gripping jaws, and the wedge moves the gripping jaws together and apart as it slides backward and forward along the angled grooves. The wedge also keeps the gripper jaws parallel to each other as they open and close. A motor moves the wedge backward and forward, and guiding surfaces attached to the base prevent the jaws from moving horizontally relative to the base.

8 Claims, 2 Drawing Sheets

WEDGE TYPE PARALLEL JAW GRIPPER FOR AUTOMATED DATA STORAGE LIBRARY

BACKGROUND OF THE INVENTION

1. Field of the Invention

The present invention relates generally to robotic gripper mechanisms.

2. Background of the Invention

Typical robotic grippers (also known as end effectors) for automated data storage libraries are slow-speed electric pinching mechanisms for gripping onto a standard sized box-shaped media cassette. The size of the data cassette usually dictates the range of movement of the gripper jaws. The simplest solution for proper movement of the jaws is to hinge them in the rear and provide an actuator to push them apart and pull them together in order to grip an object. Typically, a motor is used to drive a nut and linkage arrangement that moves the gripper fingers (jaws) together or apart. This typical gripper design has several limitations related to the variability of cassette size.

The first limitation is the finger of the gripper. Because of their pivot point, the jaws will not remain parallel to each other as the cassette size varies in its tolerance range, and certainly will not remain parallel for a non-standard or smaller form factor cassette. Parallelism is desirable to control the attitude and gripping surface friction of the jaws.

A second limitation of the prior art gripper design relates to the linkage arms that drive the jaws in a non-linear force relationship. As the finger pivot angle changes, the linkage angles change, and a small change in gripper pinch width could result in a large difference in pinch force applied to the cassette.

Therefore, it would be desirable to have a robot gripper that can grip onto several different shaped objects with consistent orientation in space to keep the objects aligned with the library structure, while retaining constant grip force.

SUMMARY OF THE INVENTION

The present invention provides a robotic gripper mechanism. The invention comprises gripping jaws and a wedge that moves along angled groove between the gripping jaws. The angled grooves are connected to the gripping jaws, and the wedge moves the gripping jaws together and apart as it slides backward and forward along the angled grooves. The wedge also keeps the gripper jaws parallel to each other as they open and close. A motor moves the wedge backward and forward, and guiding surfaces attached to the base prevent the jaws from moving horizontally relative to the base.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
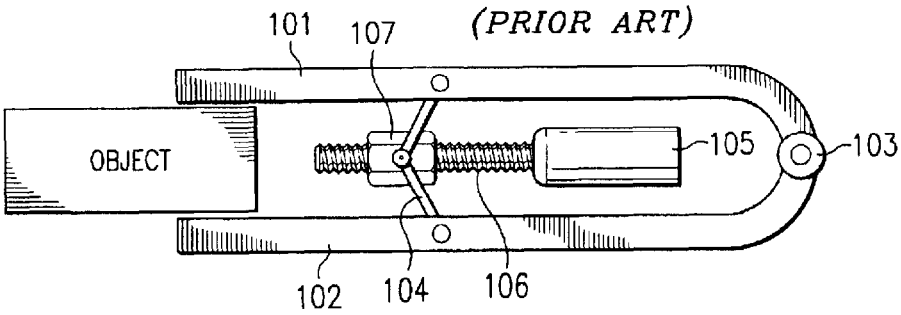
FIG. 1 (PRIOR ART)
FIG. 1 depicts a schematic diagram illustrating a typical hinged gripper robot in accordance with the prior art.

Referring now to the figures, and more specifically to FIG. 1, a schematic diagram illustrating a typical hinged gripper robot is depicted in accordance with the prior art. Typical robotic grippers for automated data storage libraries are slow speed pinching mechanisms for gripping onto a standard sized box shaped media cassette. The size of the cassette usually dictates a range of movement of the gripper jaws and the simplest solution for proper movement of the jaws is to hinge them in the rear and provide an actuator to push them apart and pull them together to pinch an object.

FIG. 1 depicts a pair of hinged jaws 101 and 102 supported by a pivot 103 in the rear and a driving linkage 104 in the front. A motor 105 is connected to a screw 106 which, when rotated, drives a nut 107 connected to the linkage 104. This typical gripper has several limitations relating to the variability of cassette size.

First, the jaws 101–102, because of their pivot point 103, will not remain parallel to each other as the cassette size varies in it's tolerance range, and certainly will not remain parallel for a non-standard or smaller form factor cassette. Parallelism would be desirable to control the attitude and griping surface friction of the jaws 101–102. Several methods have been used in the prior art for dealing with this problem.

Figure 2:
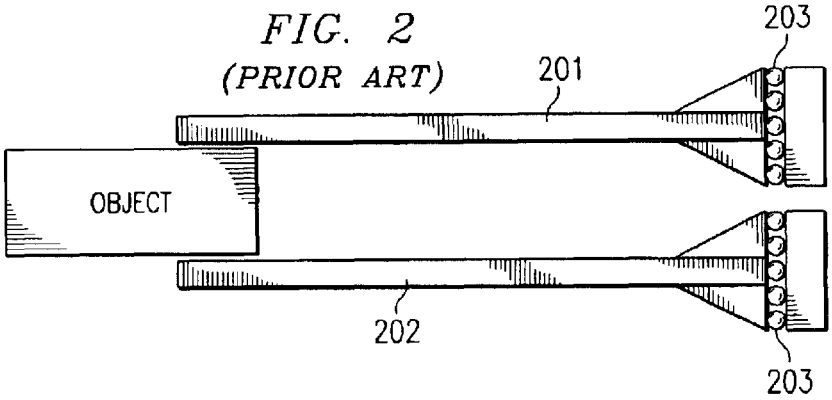
FIG. 2 (PRIOR ART)
FIG. 2 depicts a diagram illustrating a solution to controlling gripper jaws movement in accordance with the prior art.

FIG. 2 depicts a diagram illustrating a solution to controlling gripper jaws in accordance with the prior art. The gripper in FIG. 2 uses a sliding ball type of linear guide for controlling the jaws 201 and 202 in a parallel fashion. In this design, the jaws 201–202 move together and apart along linear slide bearings 203, which keep the jaws 201–202 parallel.

Figure 3:
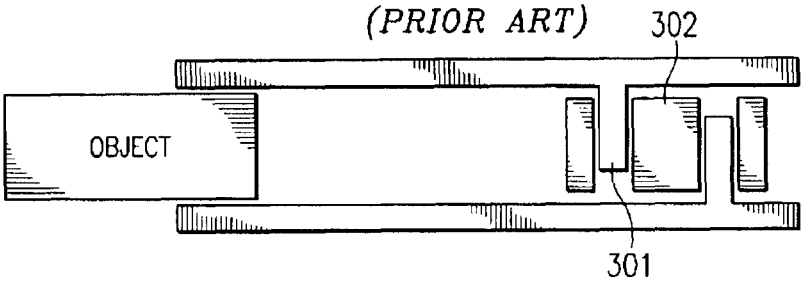
FIG. 3 (PRIOR ART)
FIG. 3 depicts a diagram illustrating a simplified version of the linear sliding approach to controlling gripper finger movement in accordance with the prior art.

FIG. 3 depicts a diagram illustrating a simplified version of the linear sliding approach in accordance with the prior art. This design operates along the same lines as the design illustrated in FIG. 2. However, in FIG. 3, the linear slide bearings are replaced with tongue-and-groove guides comprised of sliding mounts 301 moving in slots between fixed supports 302.

In both FIGS. 2 and 3, the additional structures for ensuring parallel movement take up considerable extra room in addition to the actuator components. The structures also add cost to the robot.

The second major problem with typical prior art grippers is that the linkage arms, e.g., linkage 104 in FIG. 1, can drive the gripper jaws in a non-linear force relationship. As the finger pivot angle changes, the linkage angles change, and a small change in gripper pinch width could result in a large difference in pinch force applied to the cassette.

Figure 4:
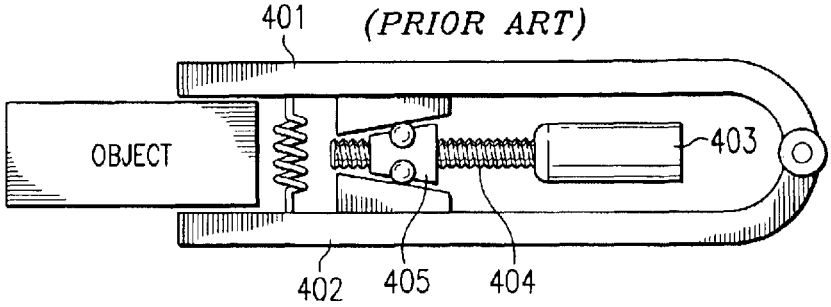
FIG. 4 (PRIOR ART)
FIG. 4 depicts a schematic diagram illustrating a method for producing linear force application to the gripper jaws in accordance with the prior art.

Referring to FIG. 4, a schematic diagram illustrating a method for producing linear force application to the gripper jaws is depicted in accordance with the prior art. The design shown in FIG. 4 illustrates a more linear design, wherein a wedging action is provided by a motor 403 connected to a screw 404 and moving wedge 405, which in turn provides a nice linear force to the jaws 401–402, even with variation in cassette thickness.

Figure 5:
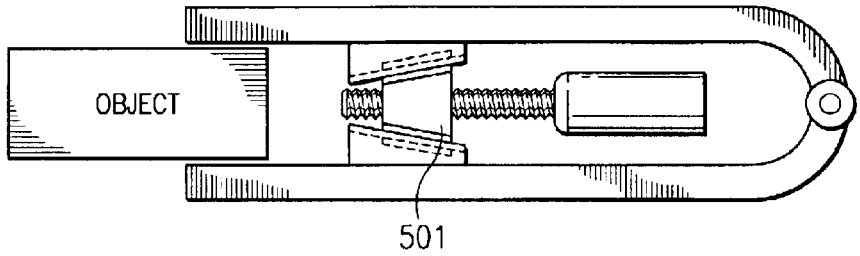
FIG. 5 (PRIOR ART)
FIG. 5 depicts another prior art design similar to FIG. 4, but substituting a grooved wedge driver block for gripper-biasing springs.

FIG. 5 depicts another prior art design similar to FIG. 4, but without the gripper-biasing springs. Instead, this design uses a grooved wedge driver block 501 with bi-directional force. However, the prior art solutions depicted in both FIGS. 4 and 5 do not address the problem of maintaining the gripper jaws in a parallel position to each other.

The present invention provides a robotic gripper that can grip several different shaped objects while retaining constant grip force. The mechanism grips with consistent force across all of the grip range and also grips the object with consistent orientation in space to keep the object in alignment with the library structure.

Figure 6:
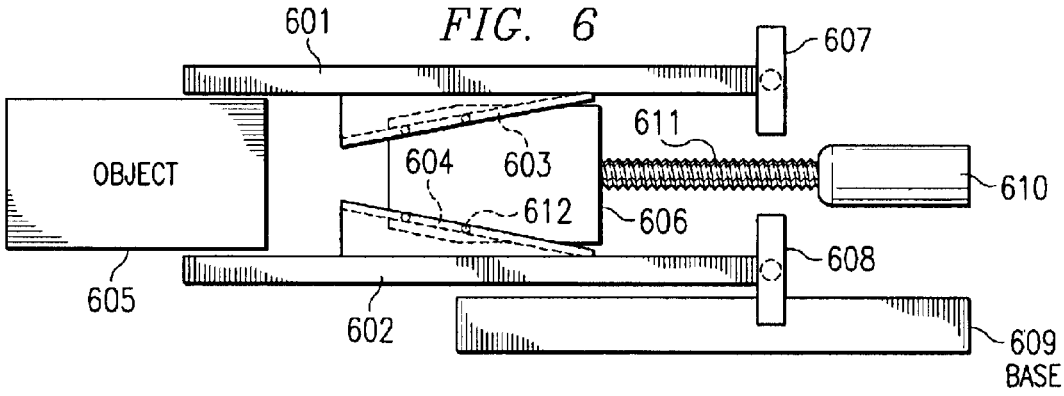
FIG. 6 depicts a schematic diagram illustrating a gripper with a parallel jaw mechanism and inertia driven wedge in accordance with the present invention.

Referring now to FIG. 6, a schematic diagram illustrating a gripper with a parallel jaw mechanism and inertia driven wedge is depicted in accordance with the present invention. The jaws 601 and 602 are supported and guided by slots 603 and 604 that are tipped at an angle. The jaws 601–602 are moveable vertically to pinch an object 605 by simply sliding the wedge 606 along the angled guide slot structures 603–604 in a horizontal direction. In addition, optional guide pins or ball bearings 612 may be placed in slots 603–604.

A motor 610 drives the wedge 606 by means of a leadscrew 611. The wedge 606 and slots 603–604 create linear force on the jaws 601–602 as they spread apart or together. Thus the guide slots 603–604 also become the driver device. In addition, the wedge 606 and guide slots 603–604 keep the jaws 601–602 parallel as they open and close, even as the size of the gripped object 605 changes. Therefore, the present invention overcomes both limitations of the prior art but without the need for additional bulky structures.

The example depicted in FIG. 6 assumes that "ribs" on the wedge 606 fit into slots 603–604. However, the design in FIG. 6 may also be switched so that guide slots are placed along the wedge 606, and structures 603 and 604 become the ribs that fit in such slots.

The guide surfaces 607 and 608 provide a way to keep the jaws 601–602 locked horizontally to the gripper base plate 609 without moving left or right relative to the plate. With these guide surfaces 607–608 in place, the sliding wedge 606 with integrated driver nut (not shown) is a means of actuating the gripper jaws 601–602 while holding them parallel, as explained above. The sliding wedge 606 is also fixed in horizontal slots (not shown) in the base plate 609 to hold the wedge 606 in vertical alignment, while allowing it to.slide left and right.

Figure 7:
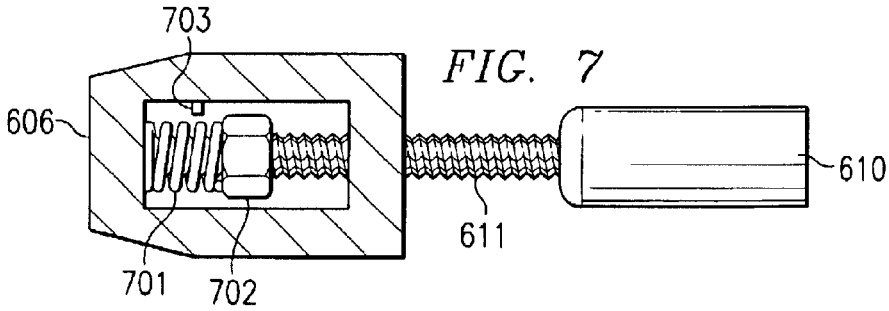
FIG. 7 depicts a schematic diagram illustrating internal details of the sliding wedge in accordance with the present invention.

Referring now to FIG. 7, a schematic diagram illustrating internal details of the sliding wedge is depicted in accordance with the present invention. FIG. 7 illustrates possible improvements that can be added to the design of the wedge 606 from FIG. 6. One improvement is a spring 701 to provide a preload between the lead driver nut 702 and the wedge 606. This allows the motor 610 to actually drive the sliding wedge 606 and hence the jaws into contact with the gripped objects at very high speeds. The spring 701 provides a mechanical damping to the collision between gripper jaws and objects to allow the motor 610 to be controlled more loosely by the servo electronics so that the motor 610 and screw 611 is not damaged by impact.

The spring 701 can be further utilized to control grip pinch forces if the screw 611 and nut 702 are used to collapse the spring 701 in increasing amounts to get more force to the jaws. The spring compression is directly related to gripper pinch force and can be measured or sensed by an electrical position sensor 703 that can turn off the gripper motor 610 at a given force value.

The features of the present invention allow the gripper to achieve unusual grip forces at unsurpassed speeds, as well as maintain a gasp on objects when power is lost.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A robotic gripper, comprising:

gripping jaws for gripping objects;

a wedge between the gripping jaws, wherein the wedge moves along angled grooves connected to the gripping jaws, and wherein the wedge moves the gripping jaws together and apart as it slides forward and backward between the jaws along the angled grooves, and wherein the wedge keeps the jaws parallel to each other as they open and close; and a motor that moves the wedge backward and forward.

2. The robotic gripper according to claim 1, further comprising:

guiding surfaces connecting the gripper jaws to a base, wherein the guiding surfaces prevent the gripping jaws from moving horizontally relative to the base as they move apart and together.

3. The robotic gripper according to claim 1, further comprising a leadscrew and nut connecting the motor and wedge, wherein the nut applies pressure to the wedge.

4. The robotic gripper according to claim 3, further comprising a spring between the nut and wedge, wherein the spring provides a mechanical damping to contact between the gripper jaws and gripped objects.

5. The robotic gripper according to claim 4, wherein the leadscrew and nut increase the compression of the spring in order to increase gripping force.

6. The robotic gripper according to claim 5, further comprising a sensor that can turn off the motor when spring compression reaches a specified maximum level.

7. The robotic gripper according to claim 1, wherein the gripper mechanism is part of an automated data storage library.

8. The robotic gripper according to claim 1, wherein the wedge moves in a direction parallel to the gripping jaws.

* * * * *